US006971848B2

(12) United States Patent
Watson

(10) Patent No.: US 6,971,848 B2
(45) Date of Patent: Dec. 6, 2005

(54) MULTISTAGE PUMP AND METHOD OF MAKING SAME

(75) Inventor: Arthur I. Watson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 134 days.

(21) Appl. No.: 10/677,003

(22) Filed: Oct. 1, 2003

(65) Prior Publication Data

US 2005/0074331 A1 Apr. 7, 2005

(51) Int. Cl.[7] ..... F04B 17/00
(52) U.S. Cl. ..... 415/213.1; 415/199.2; 415/214.1
(58) Field of Search ..... 415/199.2, 213.1, 415/214.1; 417/423.3

(56) References Cited

U.S. PATENT DOCUMENTS 1,555,635 A * 9/1925 Conant ..... 415/199.2
3,098,450 A * 7/1963 Bower ..... 415/199.2
3,238,879 A * 3/1966 Shallenberg ..... 415/199.2
3,864,057 A * 2/1975 Theron ..... 415/199.2
5,160,240 A 11/1992 Wilson
5,628,616 A 5/1997 Lee
5,845,709 A 12/1998 Mack et al.
5,908,288 A 6/1999 Moran
5,961,282 A 10/1999 Wittrisch et al.
6,076,599 A 6/2000 McKinzie
6,361,272 B1 3/2002 Bassett
6,688,860 B2 * 2/2004 Du et al. ..... 417/423.11
2002/0179305 A1 12/2002 Mack et al.

* cited by examiner

*Primary Examiner*—Edward K. Look
*Assistant Examiner*—Igor Kershteyn
(74) *Attorney, Agent, or Firm*—Van Someren, P.C.; Bryan P. Galloway; Jaime A. Castano

(57) ABSTRACT

A system and method is provided for constructing an elongated pump. The pump has multiple stages within an outer housing. Each stage comprises an impeller and a diffuser. The diffusers are divided into separate groups that are compressed during construction of the pump.

30 Claims, 4 Drawing Sheets

MULTISTAGE PUMP AND METHOD OF MAKING SAME

BACKGROUND

In a variety of environments, pumps are used to produce or otherwise move fluids. For example, multistage, centrifugal pumps utilize stacked impellers and diffusers to provide the motive force for moving fluids. The impellers are rotated by a shaft, while the diffusers guide the flowing fluid from one impeller to the next. In some applications, this type of pump is used in the production of oil. The pump may be connected into an electric submersible pumping system located, for example, in a wellbore drilled into an oil-producing formation.

When building multistage, centrifugal pumps, the diffusers are compressed to prevent diffuser rotation during operation of the pump. The axial preload applied to the stacked diffusers is greater than the opposing deflection force acting on any individual diffuser due to pressure loads from the rotating impellers. Otherwise, the upper diffuser and possibly other diffusers would be able to spin. Also, the pressure loads are cumulative, so each diffuser must support the pressure loads of all the downstream stages. The total pressure load on the diffuser farthest upstream is therefore equal to the effective pressure area of one stage multiplied by the total pressure of the pump. Accordingly, the compression preload must give a total axial deflection of the stacked diffusers that is somewhat greater than the deflection due to the cumulative pressure loads. The maximum length of the pump is limited based on the compressive strength limitations of the diffusers. It also should be noted that the maximum length of many types of centrifugal pumps can be limited by a loss of end play during compression. This can result in a "locking up" of the pump due to interference between one or more impellers and adjacent diffusers or other components.

To reduce the compression force, multiple smaller separate pumps can be connected. The separate pumps are joined by flanges and a splined coupling, but such components add to the cost of manufacture and installation. Additionally, each of the pumps must be independently tested, handled and installed.

SUMMARY

In general, the present invention provides a system and method that facilitate the construction of longer centrifugal pumps. The system and method utilize a single pump having a plurality of housing sections and at least one intermediate body mounted to the housing sections. The intermediate body enables the compressive preloading of separate groups of stages within the same pump. Thus, pumps having a greater number of stages than otherwise possible can be constructed without exceeding the compressive strength of any of the diffusers and without excessive loss of end play.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for constructing pumps. The system and method are useful with, for example, a variety of pumps used in electric submersible pumping systems. However, the devices and methods of the present invention are not limited to use in the specific applications that are described herein to enhance the understanding of the reader.

Figure 1:
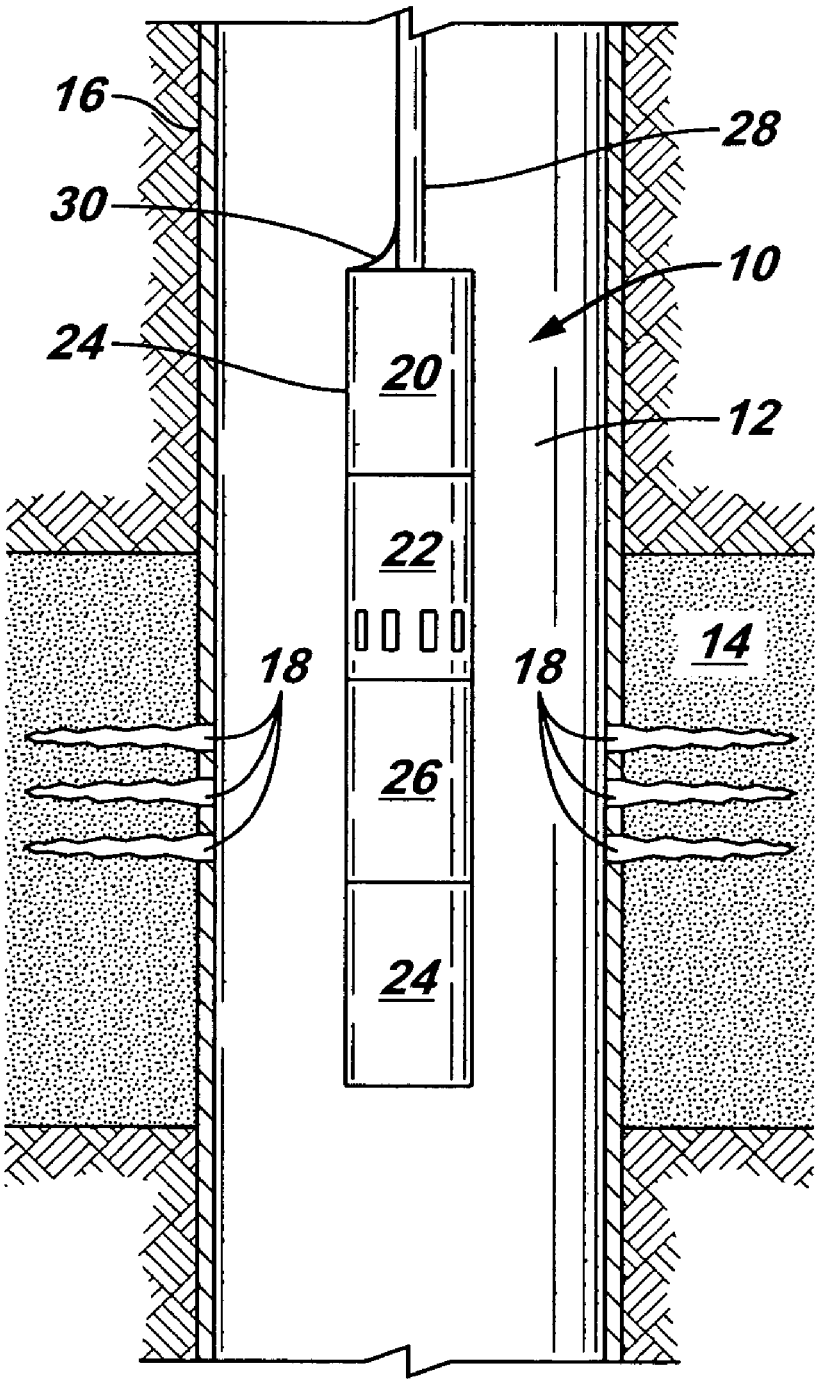
FIG. 1 is a front elevational of view of a submersible pumping system having a pump, according to an embodiment of the present invention.

Referring generally to FIG. 1, an example of an electric submersible pumping system 10 is illustrated. Although system 10 can be utilized in numerous environments, one type of environment is a subterranean environment in which system 10 is located within a wellbore 12. Wellbore 12 may be located in a geological formation 14 containing fluids, such as oil. In certain applications, wellbore 12 is lined with a wellbore casing 16 having perforations 18 through which fluid flows from formation 14 into wellbore 12.

In the embodiment illustrated, system 10 comprises a pump 20 having an intake 22. Intake 22 may be formed integrally with pump 20 or as a separate unit connected to pump 20. System 10 further comprises a submersible motor 24 and a motor protector 26 disposed between submersible motor 24 and submersible pump 20. System 10 is suspended within wellbore 12 by a deployment system 28. Deployment system 28 may comprise, for example, production tubing, coiled tubing or cable. A power cable 30 is routed along deployment system 28 and electric submersible pumping system 10 to provide power to submersible motor 24.

Figure 2:
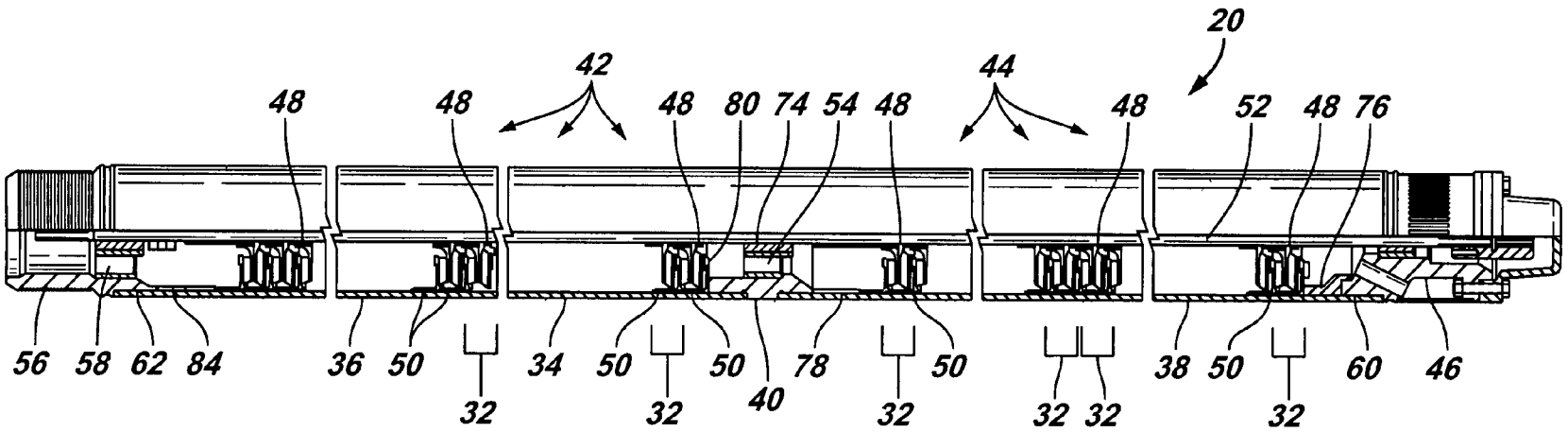
FIG. 2 is a partial cross-sectional view of an embodiment of the pump illustrated in FIG. 1.

In the illustrated example, submersible pump 20 is a centrifugal pump having one or more stages 32, as illustrated in FIG. 2. In this example, only some of the stages 32 are illustrated to facilitate explanation.

The stages 32 are enclosed in a housing 34 having a plurality of housing sections, e.g. housing section 36 and housing section 38. However, additional housing sections can be added to create an even longer housing 34. The housing sections are connected by one or more intermediate bodies 40. In the embodiment illustrated, each housing section 36, 38 is connected to an axially opposite side of intermediate body 40. However, intermediate body 40 can be anchored to one of the housing sections if the housing sections are directly connected to each other. The intermediate body 40 also may be trapped between shoulders in both housings if the housings are connected directly together.

The intermediate body 40 segregates overall housing 34 into sections and the multiple stages 32 into groups. For example, a first group 42 of stages 32 may be enclosed within housing section 36, while a second group 44 of stages 32 may be enclosed in housing section 38. Of course, the multiple stages can be divided into additional groups if one or more additional intermediate bodies 40 are added to the structure. The segregation of groups of stages ensures a reduced cumulative pressure loading in each group and enables the independent compression of the stage groups. The segregation of stages also can reduce the loss of end play when the stages are compressed.

In the specific embodiment illustrated in FIG. 2, submersible pump 20 comprises an upstream end or base 46 through which fluid is drawn into housing 34. The fluid flows into housing section 38 and is moved through stages 32 by impellers 48. Each stage 32 comprises an impeller 48 and a diffuser 50 positioned to guide the fluid from one impeller to the next downstream impeller of the next adjacent stage. The fluid is continuously pushed through the entire submersible pump 20 as impellers 48 are rotated by a shaft 52. When the flowing fluid reaches intermediate body 40, the fluid loads through flow passages 54 formed through the intermediate body, as further illustrated in FIG. 3. The fluid then enters housing section 36 and is moved from stage to stage by the impellers 48 until it reaches a downstream end or head 56. Head 56 comprises a plurality of discharge flow passages 58 through which the fluid is discharged from submersible pump 20.

Figure 3:
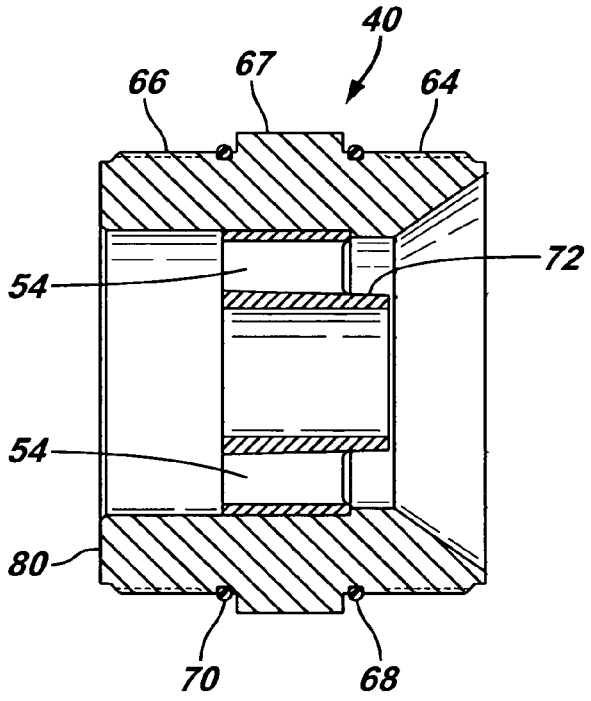
FIG. 3 is a cross-sectional view of an embodiment of the intermediate body illustrated in FIG. 2.

In this example, housing section 38 is connected to base 46 by a threaded engagement region 60. Thus, housing section 38 may be threaded onto base 46. Similarly, downstream head 56 and housing 36 are connected by a downstream threaded engagement region 62. Thus, head 56 and housing section 36 may be threaded together. Intermediate body 40 also may be threadably engaged with housing sections 36 and 38, although other connector mechanisms can be used. With further reference to FIG. 3, intermediate body 40 may be formed as a unitary structure having an upstream threaded section 64 and a downstream threaded section 66 separated by a central abutment 67. Threaded section 64 is positioned for threaded engagement with housing section 38, and threaded section 66 is positioned for threaded engagement with housing section 36 on a side of intermediate body 40 opposite threaded section 64.

Intermediate body 40 also may comprise seals 68 and 70 positioned adjacent threaded section 64 and 66, respectively. Seals 68 and 70 may be O-ring type seals that aid in forming a sealed connection between intermediate body 40 and housing sections 36 and 38. Furthermore, intermediate body 40 may comprise a bearing support 72 containing an integral or separate bearing 74 that rotatably supports shaft 52 in intermediate body 40. Thus, a single, unitary shaft can be used throughout pump 20 rather than connecting separate shafts through some type of coupling mechanism.

In the embodiment illustrated, intermediate body 40 is used to establish the compressive preloads in stage group 42 and stage group 44. For example, within housing section 38, stages 32 may be stacked against a lower diffuser spacer 76 (see FIG. 2). The compressive preload is applied to the stage group 44 by intermediate body 40 acting through, for example, a compression member 78. Compression member 78 may comprise a compression tube that is forced against the stack of diffusers 50 as intermediate body 40 is more tightly threaded onto housing section 38. Alternatively, compression member 78 may comprise a threaded ring that works independently or in cooperation with intermediate body 40 to compress the stacked diffusers 50.

Within housing section 36, the diffusers 50 of the stage group 42 are compressed against an abutment surface 80 of intermediate body 40. The compressive load force is provided by a downstream head 56 when the downstream head is threaded onto housing section 36. The force may be applied by downstream head 56 through another compression member 84 disposed between head 56 and the last diffuser at the downstream end. Alternatively, compression member 84 may comprise a threaded ring that works independently or in cooperation with downstream head 56 to compress the stacked diffusers 50. During operation of pump 20, the pressure loads acting on stage group 44 do not affect stage group 42 and vice versa. Thus, the requisite preload is reduced relative to that which would be required in a single pump with no intermediate bodies.

Figure 4:
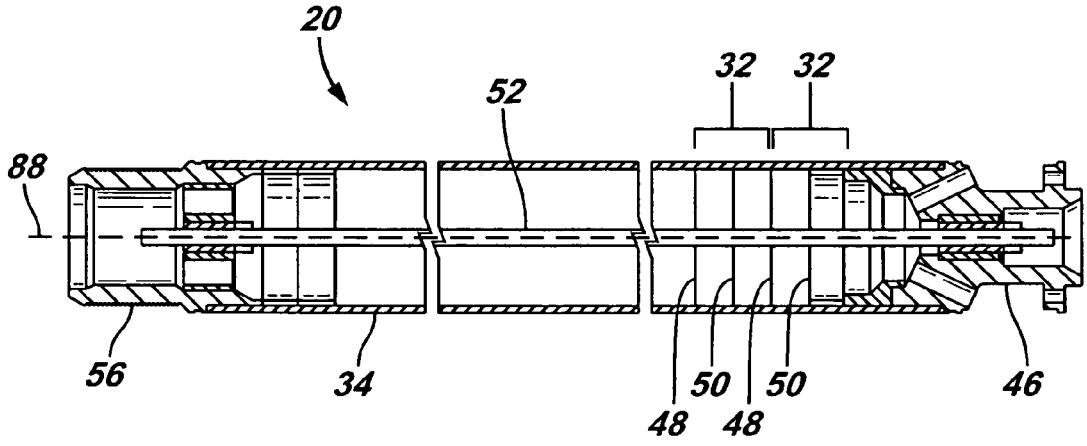
FIG. 4 is a schematic view of an embodiment of a pump to illustrate stacking of pump stages, according to on embodiment of the invention.
Figure 5:
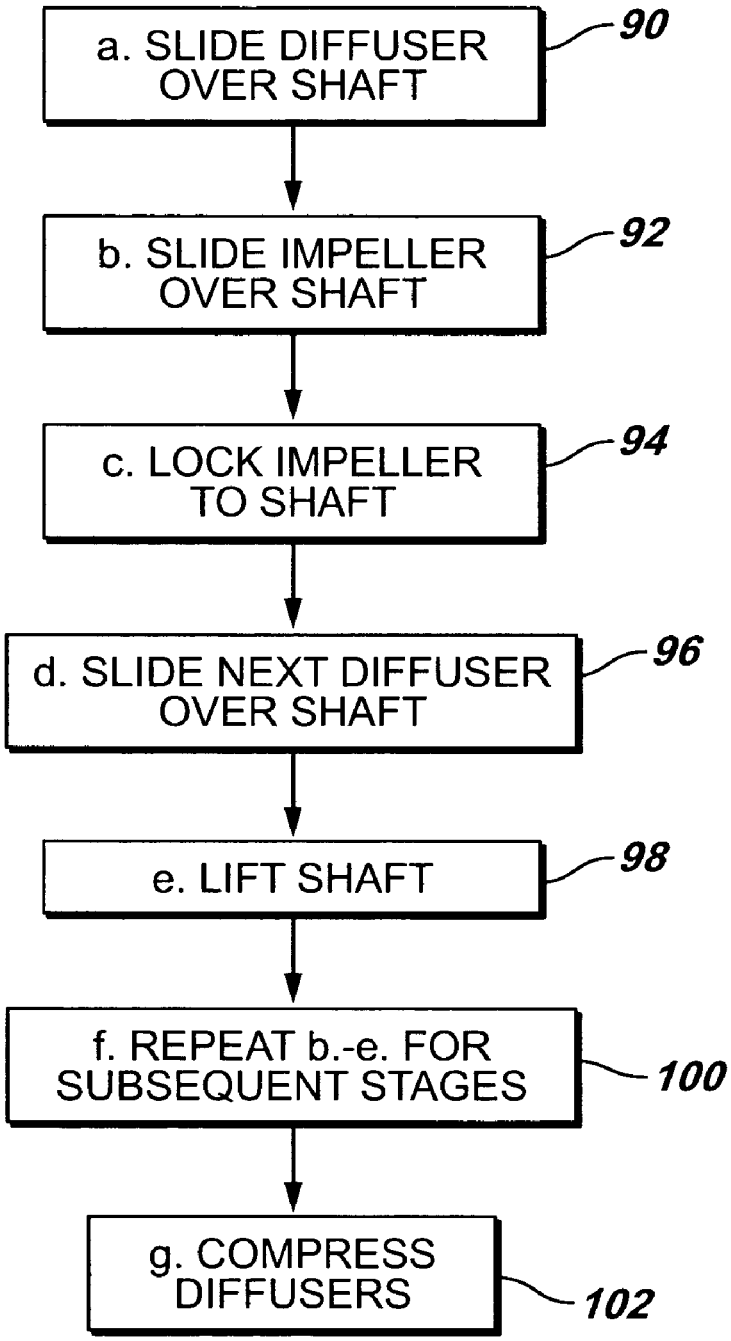
FIG. 5 is a flow chart illustrating one procedure for stacking the stages illustrated in FIG. 4.

Referring generally to FIGS. 4 and 5, an alternate method for increasing the length of certain types of centrifugal pumps is described. In these types of pumps, impellers 48 are spaced along shaft 52 and then locked to the shaft above each diffuser 50 (see FIG. 4) by, for example, a split bushing or a compression nut (not shown). The impellers 48 are positioned on shaft 52 by alternately stacking diffusers 50 and impellers 48 over shaft 52 and locking each impeller. If nothing further is done and the diffusers are compressed after the stages are stacked, the diffuser stack is shortened while the impeller stack height remains the same. If the total compression of the diffusers exceeds the end play of an individual stage, the pump can become locked. Accordingly, shaft 52 is mechanically moved in the direction of arrow 88, illustrated in FIG. 4, after each diffuser 50 is added to the stack of stages. The shaft can be moved after a plurality of diffusers are added, but the increase in pump length tends to be maximized with movement between each diffuser 50. The shaft is moved in the direction of arrow 88 a distance corresponding to the amount the diffusers will later be compressed. Thus, upon compression of the diffusers, end play is restored rather than lost. Effectively, movement of shaft 52 before each subsequent impeller is locked to the shaft enables the stacking of a greater number of stages and a lengthening of pump 20. This method can be used with or without intermediate bodies 40. Also, the method may be carried out with pump 20 positioned generally vertically such that movement of shaft 52 in the direction of arrow 88 is accomplished by lifting shaft 52 after installation of a diffuser. The actual lifting can be achieved with a variety of devices, e.g. a foot operated ratcheting friction jack, a screw jack operated by a calibrated handwheel, a screw jack operated by a servo motor or a linear electric actuator.

One example of the methodology used to increase the potential length of this type of centrifugal pump is illustrated in the flowchart of FIG. 5. Once the initial upstream base 46, housing 34 and shaft 52 are in place, an initial diffuser 50 is slid over shaft 52 (see block 90). Then, an impeller 48 is slid over shaft 52 and moved into proximity with the first diffuser 48 (see block 92). The impeller is then locked to shaft 52 (see block 94). Another diffuser 50 is then slid over shaft 52 and moved into proximity with the previously installed impeller (see block 96). Subsequently, shaft 52 is moved, e.g. lifted, by an appropriate mechanism (see block 98). The amount shaft 52 is moved after the addition of each diffuser may vary. For example, the distance of movement may vary according to the length of the pump and the position of the stage along the pump. The steps listed in blocks 92–98 are then repeated for each subsequent stage 32 (see block 100). Upon completing the stacking of stages within housing 34, the stack of diffusers 50 is compressed (see block 102) such that sufficient end play is provided to enable free rotation of impellers 48 between diffusers 50.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A pumping system, comprising:

a submersible, centrifugal pump having a first housing section, a second housing section, a unitary intermediate body to which the first housing section and the second housing section are threadably engaged, a shaft extending through the first housing section and the second housing section, a plurality of impellers and a plurality of diffusers located within the first housing section and within the second housing section, a first compression member and a second compression member positioned to independently compress the plurality of diffusers in the first housing section and in the second housing section such that the plurality of diffusers are independently preloaded in both the first housing section and the second housing section sufficiently to overcome cumulative pressure loads exerted by the plurality of impellers during operation.

2. The pumping system as recited in claim 1, wherein the shaft is a single common shaft extending through the first housing section and the second housing section.

3. The pumping system as recited in claim 1, wherein the intermediate body comprises a central abutment from which a pair of threaded regions extend in opposite directions.

4. The pumping system as recited in claim 1, wherein the intermediate body comprises a plurality of flow passages.

5. The pumping system as recited in claim 1, wherein the intermediate body comprises a central abutment and at least one seal on each side of the central abutment.

6. The pumping system as recited in claim 1, further comprising a submersible motor to drive the submersible, centrifugal pump, and a motor protector coupled to the submersible motor.

7. A method of assembling a pump having a plurality of stages, comprising:

assembling a first plurality of stages in a first housing;

attaching an intermediate body to the first housing;

compressing the first plurality of stages within the first housing to establish a preload sufficient to overcome cumulative pressure loads exerted by the plurality of impellers during operation;

connecting a second housing to the intermediate body; and compressing a second plurality of stages within the second housing to establish the preload.

8. The method as recited in claim 7, wherein compressing the second plurality of stages comprises compressing the second plurality of stages with a head member.

9. The method as recited in claim 7, wherein compressing the first plurality of stages comprises compressing the first plurality of stages with a compression member.

10. The method as recited in claim 7, wherein attaching comprises threading the intermediate body onto the first housing.

11. The method as recited in claim 10, wherein connecting comprises threading the second housing onto the intermediate body.

12. The method as recited in claim 7, wherein attaching comprises threading the intermediate body to a position at which a first plurality of diffusers is compressed.

13. The method as recited in claim 7, wherein compressing comprises compressing a second plurality of diffusers.

14. The method as recited in claim 7, further comprising installing a single, unitary shaft through the first plurality of stages and the second plurality of stages.

15. A method of extending the potential length of a centrifugal pump, comprising:

assembling a single pump with multiple stages;

locating at least one intermediate body between groups of the multiple stages;

supporting the at least one intermediate body with an external housing; and separately loading at least one group of the multiple stages on each side of the at least one intermediate body by compressing the at least one group with at least one compression member disposed on each side of the at least one intermediate body.

16. The method as recited in claim 15, wherein supporting comprises threading housing sections to the at least one intermediate body.

17. The method as recited in claim 15, wherein separately loading comprises loading a plurality of diffusers in each group of the multiple stages.

18. The method as recited in claim 15, wherein loading comprises first axially loading one group of stages within a first housing section via the intermediate body; then compressing another group of stages against an opposite side of the intermediate body and within a second housing section.

19. The method as recited in claim 15, wherein loading comprises applying a force against at least one group of the multiple stages with a compression member.

20. The method as recited in claim 19, wherein applying comprises applying the force with a compression tube.

21. The method as recited in claim 19, wherein applying comprises applying the force with a threaded compression ring.

22. A system for assembling a pump, comprising:

means for assembling a single submersible pumping system pump by alternately stacking diffusers and impellers on a shaft;

means for locking each impeller to the shaft; and means for pulling the shaft to draw each impeller toward an adjacent diffuser before stacking a next sequential diffuser and impeller on the shaft.

23. The system as recited in claim 22, wherein the means for assembling comprises an outer housing.

24. The system as recited in claim 22, wherein the means for assembling comprises an intermediate body.

25. A method of increasing the potential length of a multistage pump in which each stage has an impeller and a diffuser, comprising:

a. alternately stacking a diffuser and an impeller over the shaft;

b. locking the impeller to the shaft;

c. pulling the shaft to draw the impeller towards the diffuser; and d. repeating steps a., b. and c.

26. The method as recited in claim 25, wherein repeating comprises repeating steps a., b. and c. for each stage of the pump.

27. The method as recited in claim 26, further comprising compressing the diffusers.

28. The method as recited in claim 25, further comprising varying a distance the shaft is pulled for different stages.

29. The method as recited in claim 25, wherein pulling comprises lifting the shaft.

30. The method as recited in claim 25, wherein alternately stacking comprises alternately stacking a single diffuser and a single impeller over the shaft.

* * * * *